US007580044B2

(12) United States Patent
Tung et al.

(10) Patent No.: US 7,580,044 B2
(45) Date of Patent: Aug. 25, 2009

(54) METHOD AND APPARATUS FOR NON-LINEAR DITHERING OF IMAGES

(75) Inventors: Hsu-Jung Tung, Kao-Hsiung (TW); Chun-Hsing Hsieh, Hsin-Chu (TW); Yu-Pin Chou, Miao-Li Hsien (TW); Hsien-Chun Chang, Chi-Lung (TW)

(73) Assignee: Realtek Semiconductor Corp., HsinChu (TW)

( * ) Notice: Subject to any disclaimer, the term of this patent is extended or adjusted under 35 U.S.C. 154(b) by 268 days.

(21) Appl. No.: 11/163,887

(22) Filed: Nov. 2, 2005

(65) Prior Publication Data

US 2006/0092172 A1 May 4, 2006

(30) Foreign Application Priority Data

Nov. 3, 2004 (TW) ..... 93133531 A

(51) Int. Cl.
*G09G 5/02* (2006.01)

(52) U.S. Cl. ..... 345/596; 345/597; 345/598

(58) Field of Classification Search ..... 345/418, 345/581, 589, 596, 597
See application file for complete search history.

(56) References Cited

U.S. PATENT DOCUMENTS 5,264,840 A * 11/1993 Wells et al. ..... 345/599
5,371,515 A * 12/1994 Wells et al. ..... 345/596
5,404,427 A * 4/1995 Cawley et al. ..... 345/597
5,745,259 A * 4/1998 Ulichney ..... 358/3.23
5,777,599 A * 7/1998 Poduska, Jr. ..... 345/596
5,917,952 A * 6/1999 Noh ..... 358/3.07
5,946,452 A * 8/1999 Spaulding et al. ..... 358/1.9
6,469,708 B1 * 10/2002 Wu et al. ..... 345/596
6,862,111 B2 * 3/2005 Lin et al. ..... 358/1.9
6,995,863 B1 * 2/2006 Miguel ..... 358/1.9
7,012,717 B1 * 3/2006 Easwar ..... 358/3.13
7,253,819 B1 * 8/2007 Ganea ..... 345/600
7,330,193 B2 * 2/2008 Bhattacharjya ..... 345/593
7,330,291 B2 * 2/2008 Abe ..... 358/3.06
2002/0163528 A1 * 11/2002 Cooper ..... 345/596
2003/0035146 A1 * 2/2003 Yu et al. ..... 358/3.14
2004/0051717 A1 * 3/2004 Naiki ..... 345/596
2004/0080521 A1 * 4/2004 Nose et al. ..... 345/690
2005/0174360 A1 * 8/2005 Daly et al. ..... 345/596
2006/0221239 A1 * 10/2006 Thebault et al. ..... 348/571

OTHER PUBLICATIONS

Computer Graphics: Principles and Practice—Second Edition in C; Foley, van Dam, Feiner, Hughes; ISBN 0-201-84840-6; 1996.*

* cited by examiner

*Primary Examiner*—Kee M Tung
*Assistant Examiner*—Crystal Murdoch
(74) *Attorney, Agent, or Firm*—Winston Hsu

(57) ABSTRACT

A method for dithering an image is disclosed, which includes: storing a plurality of dithering parameters corresponding to a predetermined function for a predetermined input intensity range; and dithering pixels of the predetermined input intensity range according to the plurality of dithering parameters.

20 Claims, 9 Drawing Sheets

METHOD AND APPARATUS FOR NON-LINEAR DITHERING OF IMAGES

BACKGROUND OF THE INVENTION

1. Field of the Invention

The present invention relates to image processing techniques, and more particularly, to methods and apparatus for non-linear dithering of images.

2. Description of the Prior Art

The bit numbers employed to express the respective pixels of an image, also known as the bit depth, determines the color depth of the image. In general, the visual quality of the image increases with the color depth.

The bit depth of the conventional display medium is limited; such as the computer monitor, the PDA display panel, and so forth. Conventionally, if the bit depth of the display medium is less than the color depth of the image to be displayed, then a technique is to be employed to display the image having more color depth on the display medium having less color depth. This technique, when applied to a display medium, is called dithering. In a printing context the same process is referred to as half toning. For example, when a 6 bits display medium is utilized to display an 8 bits image, the dithering technique is employed to display the image having more color depth on the display medium with lower bit depth.

Please refer to FIG. 1, which shows a simplified diagram describing a relationship between input intensity and output intensity of a display medium. The transverse axis of FIG. 1 is the input intensity of the display medium while the vertical axis is the output intensity of the display medium. Depending upon the type of the display medium, the input intensity may be the voltage of an electron gun, the input digital signal value of the display medium, etc. In FIG. 1, a point A corresponding to an input intensity 64 and a point B corresponding to an input intensity 68, are intensities that the display medium is capable of displaying without the need to utilize a dithering operation. The intermediate points corresponding to input intensities 65, 66, and 67, (i.e., the X points shown on FIG. 1), correspond to intensities that can be simulated by utilizing the dithering operations. As shown in FIG. 1, the X points are the dithered intensities obtained by the conventional dithering operations. The X points are located on a straight line defined by points A and B. In other words, the conventional dithering operations are linear dithering operations.

However, the conventional linear dithering operations cannot satisfy the requirements of many display media. FIG. 2 shows a diagram 200 describing a relationship between input intensity and output intensity of a display medium with a typical gamma characteristic. As is well known to those of ordinary skill in the art, the term gamma characteristic is used to describe the non-linear relationship between the input intensity of the display medium and its actual output value. Typically, the display characteristic of the display medium is a curve such as a dotted curve 210 shown in FIG. 2. The dithered display characteristic is then a polygonal line such as a bold line 220 composed of a plurality of linear line segments shown in FIG. 2. The points where the bold line 220 intersects the dotted curve 210 are the intensities that the display medium is capable of displaying without the need to utilize a dithering operation. According to FIG. 2, it is obvious that the output characteristic represented by the bold line 220 that is obtained by the conventional linear dithering operations cannot accurately enough reflect the non-linear characteristic (i.e., the dotted curve 210) of the display medium. This is especially significant along the curvature of the dotted curve 210 where it is greater than the others such as the range from input intensity 251 through 255.

SUMMARY OF THE INVENTION

It is therefore an objective of the claimed invention to provide a non-linear dithering method and apparatus.

According to an exemplary embodiment of the present invention, a method for dithering an image is disclosed comprising: storing a plurality of dithering parameters corresponding to a predetermined function for a predetermined input intensity range; and dithering pixels of the predetermined input intensity range according to the plurality of dithering parameters.

According to an exemplary embodiment of the present invention, another method for dithering an image is disclosed comprising: generating a plurality of dithering parameters corresponding to a predetermined input intensity range according to a predetermined function; and dithering pixels of the predetermined input intensity range according to the plurality of dithering parameters.

According to an exemplary embodiment of the present invention, an image dithering device is disclosed comprising: a storage medium for storing a plurality of dithering parameters corresponding to a predetermined function for a predetermined input intensity range; and a processing unit for dithering pixels of the predetermined input intensity range according to the plurality of dithering parameters.

These and other objectives of the present invention will no doubt become obvious to those of ordinary skill in the art after reading the following detailed description of the preferred embodiment that is illustrated in the various figures and drawings.

DETAILED DESCRIPTION

In the following embodiment, an image with P-bit color depth is to be dithered into an image with Q-bit color depth, where Q can be any integer while P is another integer being greater than Q. For convenient descriptions and illustrations, P is herein assumed to be 8 and Q is assumed to be 6. In other words, after the dithering processes in the following embodiment, the bit number utilized to express each pixel is reduced to 6 bits from 8 bits. Note that the dithering method and apparatus disclosed below may be applied in various image output devices including image display devices and image printing devices such as CRT monitors, LCD displays, printers, and the like.

Figure 1:
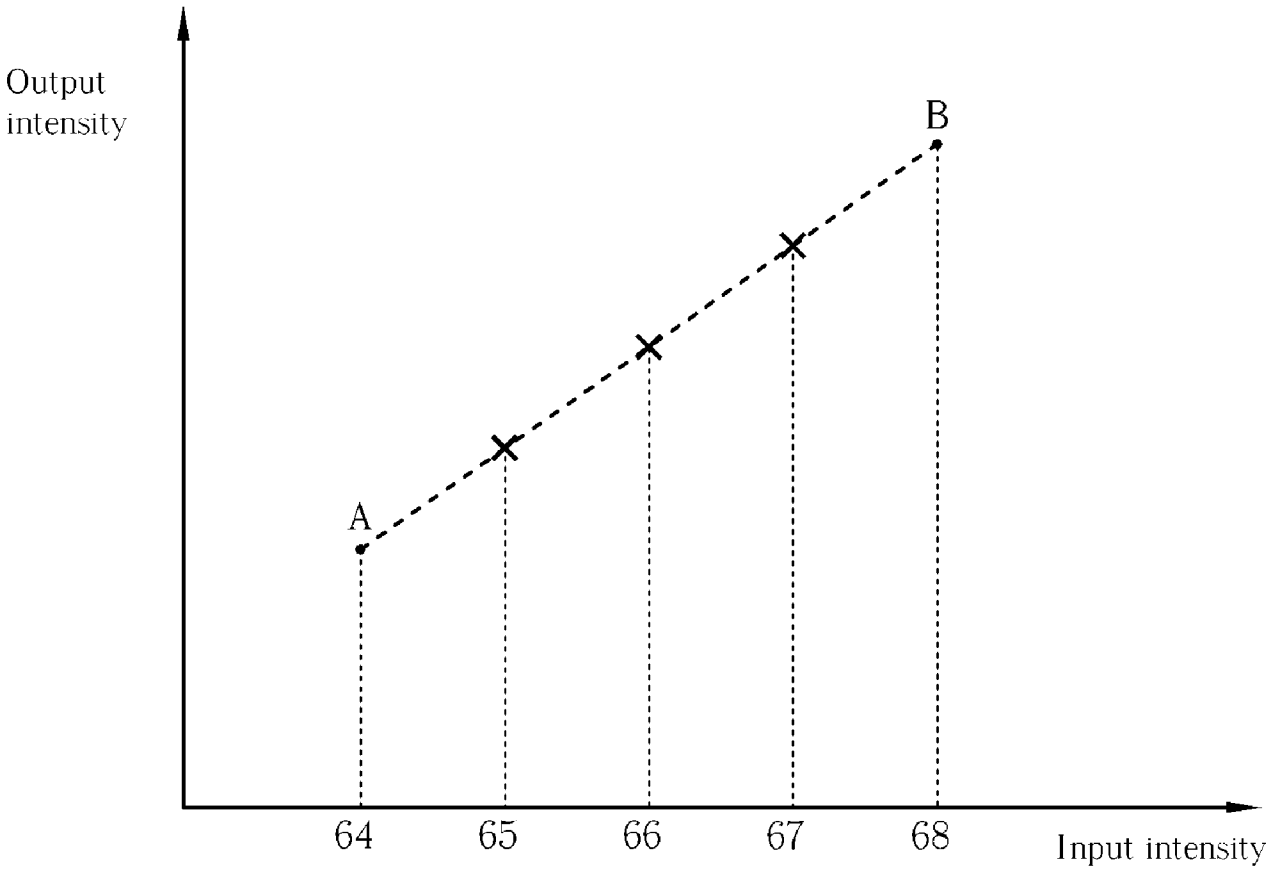
Fig. 1 Prior art
FIG. 1 is a simplified diagram describing a relationship between input intensity and output intensity of a display medium.
Figure 2:
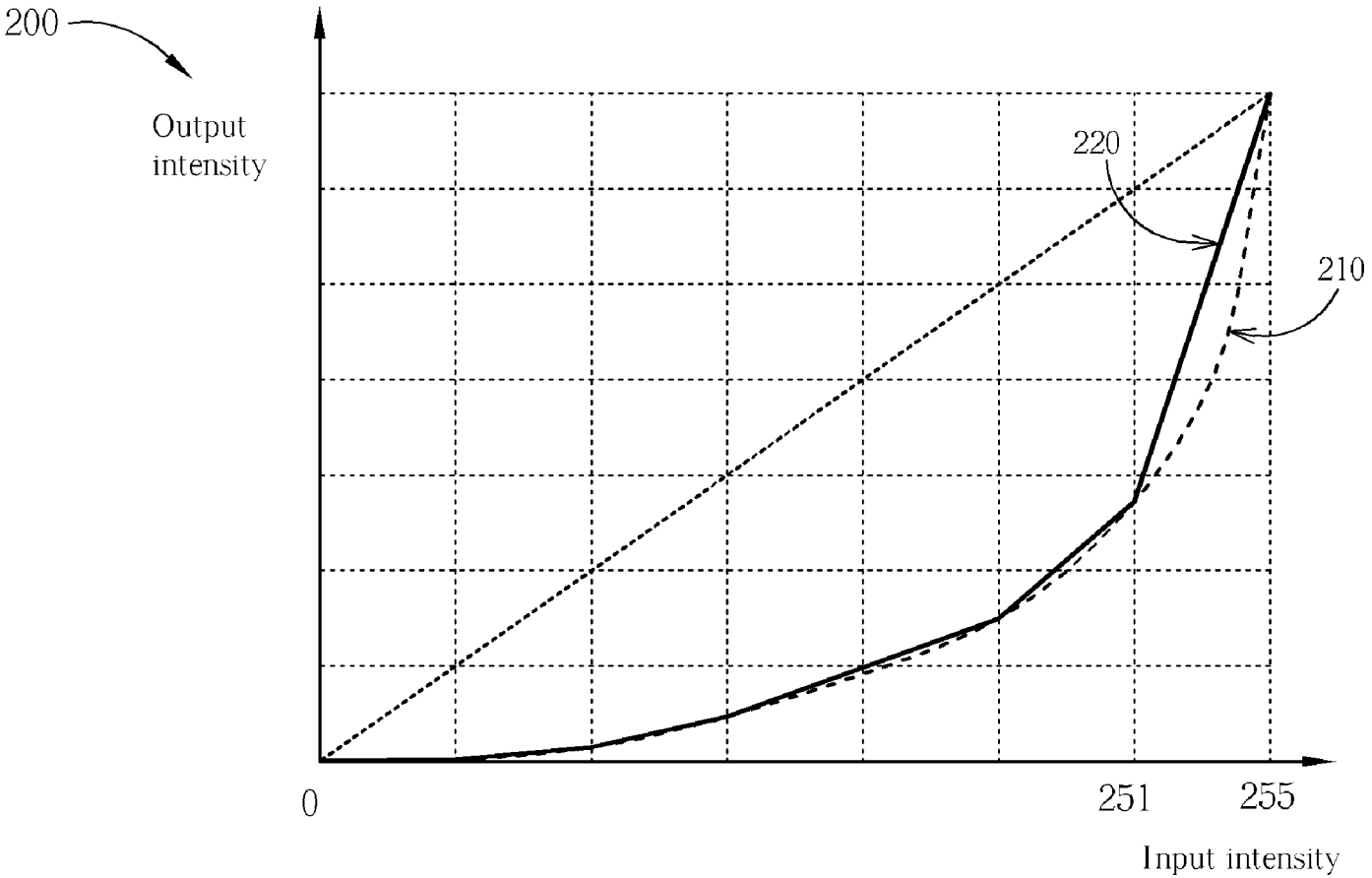
Fig. 2 Prior art
FIG. 2 is a diagram describing a relationship between input intensity and output intensity of a display medium with a typical gamma characteristic.
Figure 3:
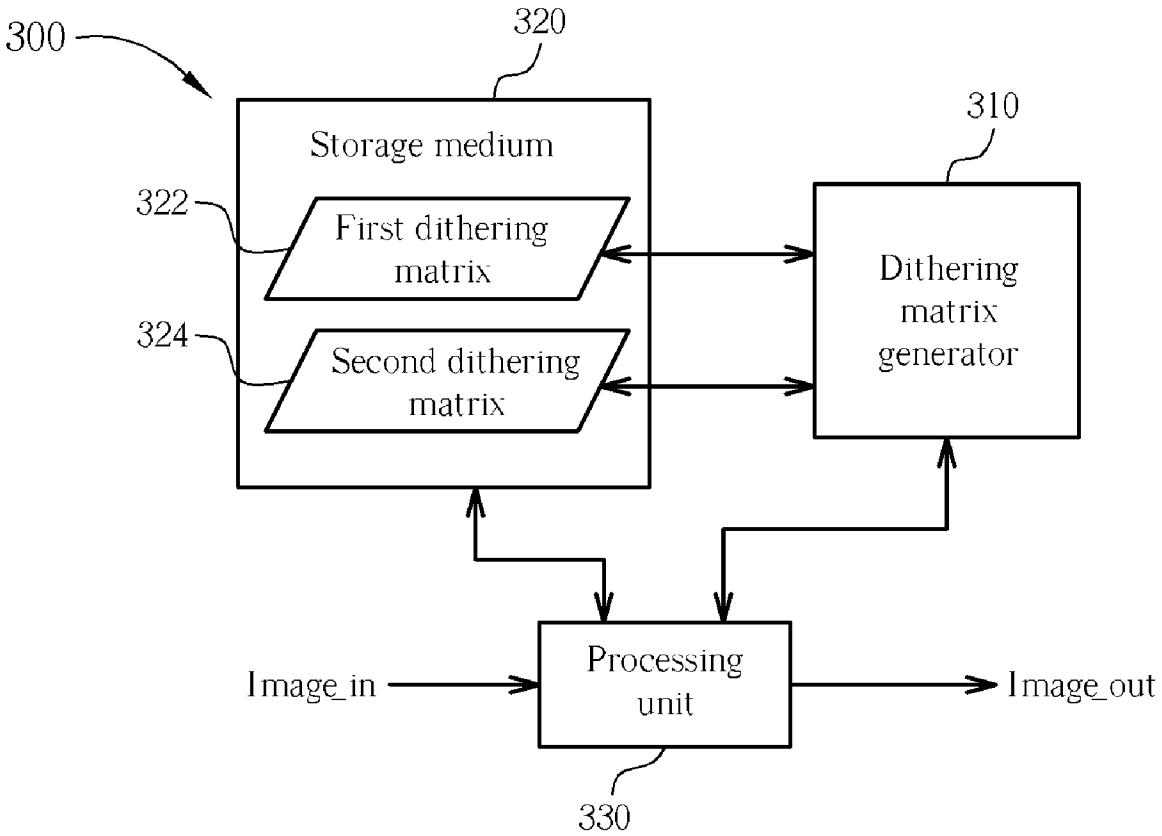
FIG. 3 is a block diagram of an image dithering device of an image output device according to an exemplary embodiment of the present invention.

Please refer to FIG. 3, which depicts a block diagram of an image dithering device 300 of an image output device according to an exemplary embodiment of the present invention. As shown in FIG. 3, the image dithering device 300 comprises a dithering matrix generator 310, a storage medium 320, and a processing unit 330. In this embodiment, the image dithering device 300 is utilized to dither an original image, Image_in, comprising 8-bit color depth, into a dithered image, Image_out, comprising 6-bit color depth.

Figure 4:
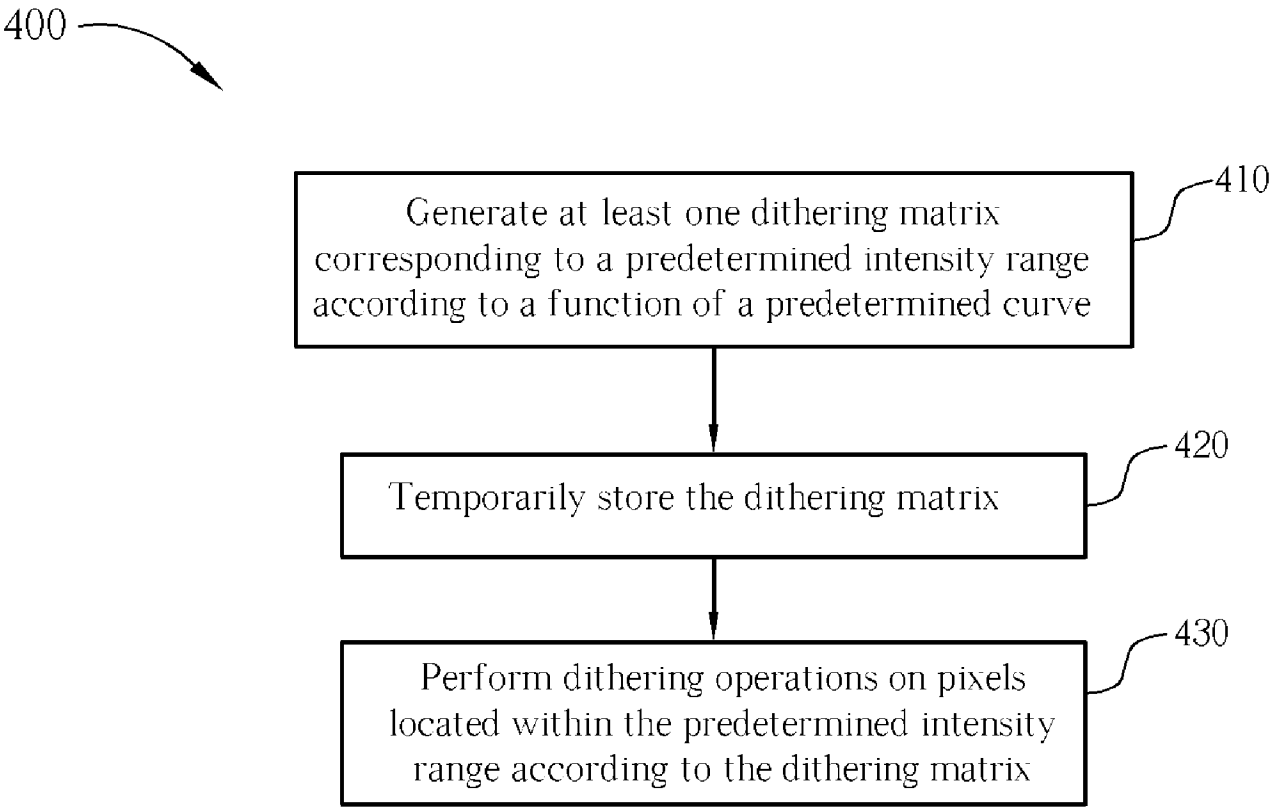
FIG. 4 is a flowchart illustrating an image dithering method according to an exemplary embodiment of the present invention.

FIG. 4 shows a flowchart 400 illustrating an image dithering method according to an exemplary embodiment of the present invention. The steps of the flowchart 400 are described below.

Figure 6:
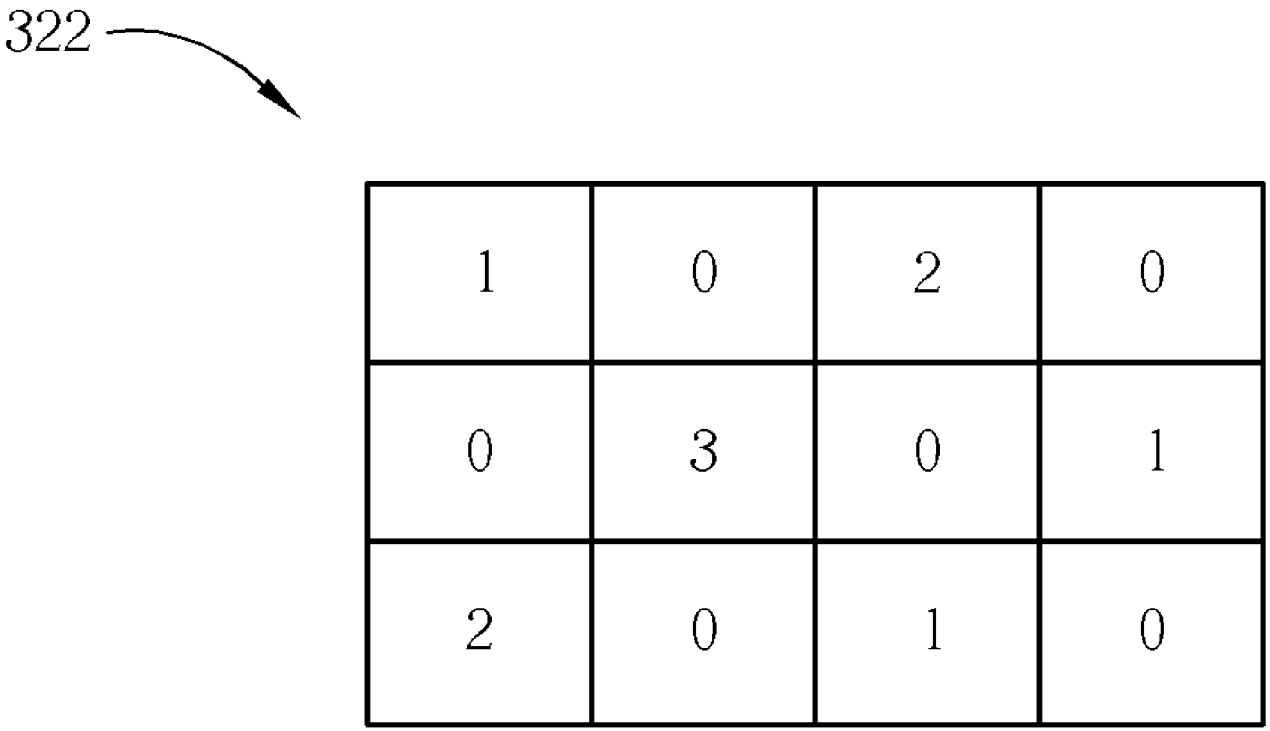
FIG. 6 is a schematic diagram of a first dithering matrix of FIG. 3 according to an exemplary embodiment of the present invention.

In step 410, the dithering matrix generator 310 of the image dithering device 300 generates at least one dithering matrix corresponding to a predetermined intensity range according to a function of a predetermined curve. For convenient elaborations, the predetermined curve is herein assumed to be the gamma characteristic curve corresponding to the image output device. In practice, the dithering matrix generator 310 may create a corresponding dithering matrix for each intensity interval within the predetermined intensity range or merely create a dithering matrix for a specific intensity interval within the predetermined intensity range. In this embodiment, the dithering matrix generator 310, in step 410, generates a first dithering matrix 322 as shown in FIG. 6 corresponding to a specific intensity interval within the predetermined intensity range and a second dithering matrix 324 corresponding to the other intensity intervals within the predetermined intensity range. The further details of generating the dithering matrixes 322 and 324 utilizing the dithering matrix generator 310 are described below.

Figure 5:
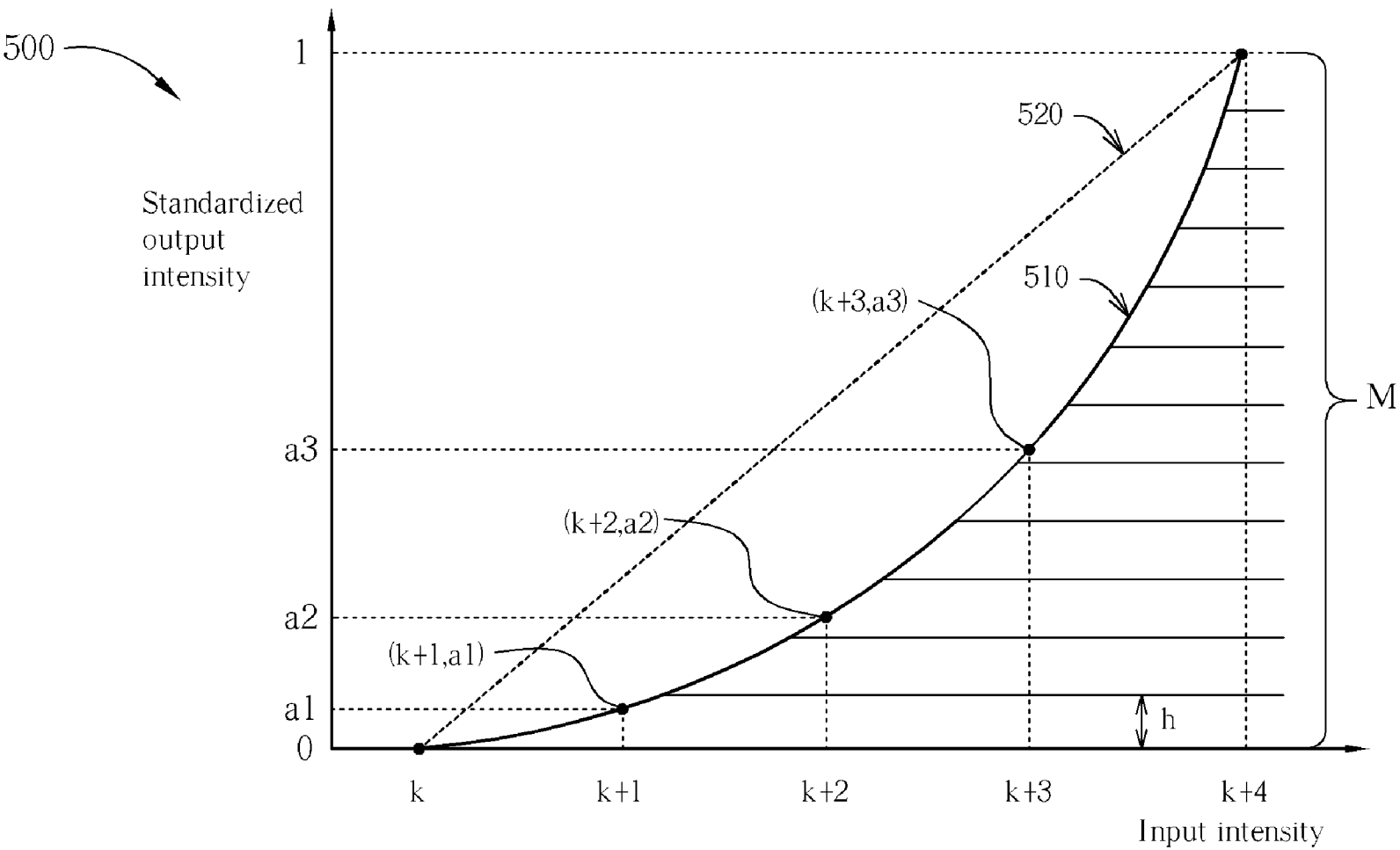
FIG. 5 is a simplified relationship diagram describing a display characteristic of an image output device equipped with the image dithering device of FIG. 3 within a specific intensity interval.

FIG. 5 is a simplified relationship diagram 500 describing a display characteristic of the image output device equipped with the image dithering device 300 within the specific intensity interval. In FIG. 5, only display characteristic of the image output device with respect to the specific intensity interval is shown for convenient elaborations. The transverse axis of FIG. 5 is the input intensity of the image output device. The input intensities, in this embodiment, are the pixel values of the original image, Image_in. The vertical axis is the output intensity of the image output device. In this embodiment, the upper boundary and the lower boundary of the specific intensity interval are respectively expressed as k+4 and k, such as intensity 68 and 64. A curve 510 shown in FIG. 5 is a target curve of the dithering method of this embodiment. In this embodiment, the curve 510 is the gamma characteristic curve corresponding to the image output device while a straight line 520 represents a dithered result obtained by utilizing linear dithering operations.

Before the dithering operations, each intensity, from intensities k through k+4 (including intensities k, k+1, k+2, k+3, and k+4), of the original image, Image_in, input to the image dithering device 300 are represented in 8 bits. Since the dithered image, Image_out, can only represent those intensities in 6 bits, only intensities k and k+4 can be expressed. Therefore, the dithering method should be applied to simulate those intensities between k and k+4, so as to compensate for the color depth. In this embodiment, the information required for dithering the original image is contained in the first dithering matrix 322 shown in FIG. 6.

As shown in FIG. 6, the first dithering matrix 322 of this embodiment is composed of entries with values ranging from 0~3, and the appearance probabilities of respective values are determined by positions on the target curve 510 of FIG. 5 which are corresponding to the intensities k+1, k+2 and k+3. In other words, the appearance probabilities of respective values within the first dithering matrix 322 are decided according to the function of the target curve 510.

Typically, the function of the target curve 510 is known. In this embodiment, for example, the target curve 510 is the gamma characteristic curve of the image output device, so that the function is depending upon the characteristic of the image output device and is well known to those of ordinary skill in the art. Accordingly, the appearance probabilities of respective values within the first dithering matrix 322 are easily obtained according to the positions on the target curve 510 with respect to the intensities k+1, k+2 and k+3. For example, the target curve 510 is vertically divided into M equal intervals and the appearance probabilities of respective values within the first dithering matrix 322 can be obtained according to the intervals where the points of the target curve 510 corresponding to the intensities k+1, k+2 and k+3 are located. The value of M is adjustable based on the design choice and not limited to any specific number.

In this embodiment, the target curve 510 of FIG. 5 is vertically divided into 12 equal intervals of a height h. In FIG. 5, a point (k+1,a1) on the target curve 510 with respect to the intensity k+1 is located in the first interval from the bottom, which means that when dithering M pixels to simulate the intensity k+1, one of the M pixels should be assigned the intensity k+4 while the other M−1 pixels should be assigned the intensity k. In other words, the appearance probability of the value 3 within the first dithering matrix 322, $P_{\#3}$, can be expressed as:

$$P_{\#3}=\text{the interval where the point of the target curve } \mathbf{510} \text{ with respect to the intensity } k+1 \text{ is located}/M=1/12 \quad (1)$$

In FIG. 5, a point (k+2,a2) on the target curve 510 with respect to the intensity k+2 is located in the third interval from the bottom, which means that when dithering M pixels to simulate the intensity k+2, three of the M pixels should be assigned the intensity k+4 while the other M−3 pixels should be assigned the intensity k. Accordingly, a sum of the appearance probability of the value 2, $P_{\#2}$, and the appearance probability of the value 3, $P_{\#3}$, can be expressed as:

$$P_{\#2}+P_{\#3}=\text{the interval where the point of the target curve } \mathbf{510} \text{ with respect to the intensity } k+2 \text{ is located}/M=3/12 \quad (2)$$

Additionally, a point (k+3,a3) on the target curve 510 with respect to the intensity k+3 is located in the sixth interval from the bottom, this means that when dithering M pixels to simulate the intensity k+3, six of the M pixels should be assigned the intensity k+4 while the other M−6 pixels should be assigned the intensity k. Accordingly, a sum of the appearance probabilities of the values 1, 2, and 3 within the first dithering matrix 322 can be expressed as:

$$P_{\#1}+P_{\#2}+P_{\#3}=\text{the interval where the point of the target curve } \mathbf{510} \text{ with respect to the intensity } k+3 \text{ is located}/M=6/12 \quad (3)$$

According to the formulas (1), (2), and (3), it can be calculated that the appearance probability of the value 3 $P_{\#3}=1/12$, the appearance probability of the value 2 $P_{\#2}=1/6$, the appearance probability of the value 1 $P_{\#1}=1/4$, and the appearance probability of the value 0 $P_{\#0}=1-(P_{\#1}+P_{\#2}+P_{\#3})=1/2$.

Once the appearance probabilities of the values within the first dithering matrix 322 are obtained, the dithering matrix generator 310, in step 410, can utilize a random number generator to generate the first dithering matrix 322 according to the obtained appearance probabilities. Note that the first dithering matrix 322 shown in FIG. 6 is merely an example. In practice, the size of the first dithering matrix 322 is adjustable and not limited to the embodiment of FIG. 6.

In this embodiment, the second dithering matrix 324 is also composed of values 0~3. The second dithering matrix 324 is utilized to dither pixels within the other intensity intervals. Since the characteristic of the target curve 510 may be different in different intensity intervals, the values within respective dithering matrixes recorded in the storage medium 320 may be different.

In step 420, the dithering matrix generator 310 then temporarily stores the first dithering matrix 322 and the second dithering matrix 324 into the storage medium 320.

In step 430, the processing unit 330 performs dithering operations on pixels located within the predetermined intensity range according to the first dithering matrix 322 or the second dithering matrix 324. In this embodiment, the processing unit 330 performs dithering operations on pixels located within the specific intensity interval (k, k+4) according to the first dithering matrix 322 and performs dithering operations on pixels located within the other intensity intervals within the predetermined intensity range according to the second dithering matrix 324.

Figure 7:
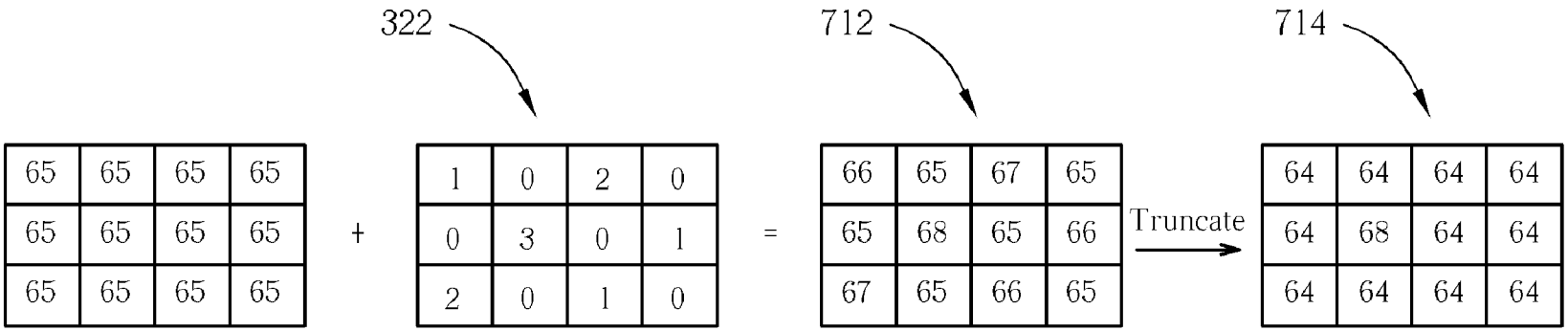
FIG. 7 is a schematic diagram describing a dithering operation made by a processing unit of FIG. 3 according to an exemplary embodiment of the present invention.

FIG. 7 shows a schematic diagram describing a dithering operation made by the processing unit 330 according to an exemplary embodiment of the present invention. In this embodiment, the input intensity is assumed to be 65. When dithering pixels in a portion of the image to simulate the visual effect of the intensity 65, the dithering method of this embodiment first adds the intensity 65 to the first dithering matrix 322 to generate an intermediate matrix 712 as shown in FIG. 7. Each value within the intermediate matrix 712 is then truncated so as to generate a resulting matrix 714 composed of only the intensities k or k+4 (i.e., 64 or 68 in this embodiment) that the image output device can express without the need to utilize a dithering operation. The truncation operation adjusts intensities being less than k+4 to k and also adjusts intensities being greater than k+4 to k+4. As a result, the image output device is capable of simulating the visual effect of the target intensity (i.e., the intensity 65 in this embodiment) by utilizing the resulting matrix 714 obtained by the aforementioned dithering operations.

Figure 8:
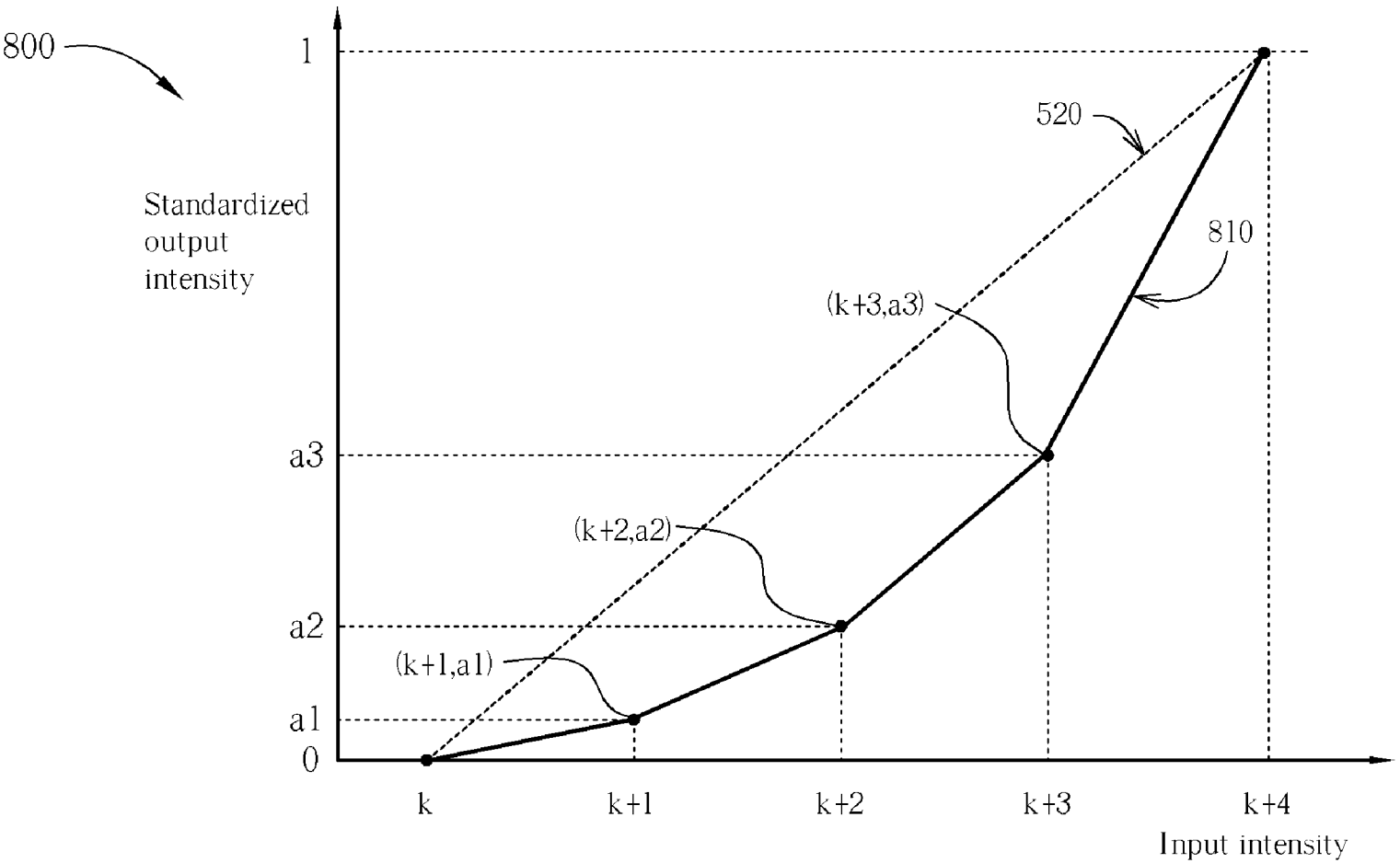
FIG. 8 is a simplified relationship diagram describing a modified display characteristic of the image output device equipped with the image dithering device of FIG. 3 within the specific intensity interval.

Please refer to FIG. 8 as well as FIG. 5. FIG. 8 shows a simplified relationship diagram 800 describing a modified display characteristic of the image output device equipped with the image dithering device 300 within the specific intensity interval (k,k+4). As mentioned above, the appearance probabilities of respective values within the first dithering matrix 322 are decided by the function of the target curve 510. Therefore, the actual display characteristic of the image output device within the specific intensity interval is represented as a polygonal line 810. In contrast to FIG. 5, the polygonal line 810 of FIG. 8 is far closer to the target curve 510 than the straight line 520. In other words, the dithering method of the present invention is capable of significantly reducing the color gap between the dithered image, Image_out, and the original image, Image_in, and thereby improves the quality of the dithered image.

In general, utilizing a large-sized dithering matrix to perform dithering operations can avoid periodic artifacts from appearing in the dithered image, Image_out. If the available memory space is a concern, the dithering matrix generator 310 can generate small-sized dithering matrix to be employed in the dithering operations. In order to reduce the possibility of periodic artifacts when utilizing the small-sized dithering matrix, the dithering matrix generator 310 can then intermittently adjust the entries of the first dithering matrix 322, or the second dithering matrix 324, or both the first dithering matrix 322 and the second dithering matrix 324. For example, the dithering matrix generator 310 may randomly rearrange the values within the dithering matrix or store a plurality of dithering matrixes corresponding to a single intensity interval. Preferably, during the above processes, the appearance probabilities of respective values within the dithering matrix accessed by the processing unit 330 are retained in an effort to maintain the dithering performance.

Figure 9:
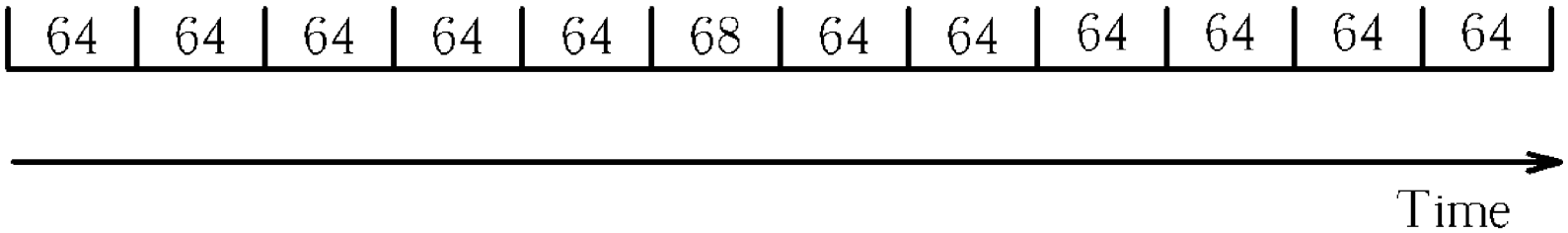
FIG. 9 is a time line diagram describing intensity changes of a specific pixel location according to an exemplary embodiment of the present invention.

Note that the non-linear dithering methods disclosed above can be applied in some predetermined intensity intervals, or applied in each intensity interval. In addition, the aforementioned non-linear dithering methods can be implemented in the spatial domain, or the temporal domain, or both the spatial domain and the temporal domain. For example, when the non-linear dithering method is implemented in the temporal domain, the appearance frequencies of the intensities k and k+4 of a specific pixel location are determined according to the appearance probabilities of respective values within the dithering matrix decided by the function of the target curve 510. FIG. 9 shows a time line diagram describing intensity changes of a specific pixel location according to an exemplary embodiment of the present invention. As shown in FIG. 9, the values within the resulting matrix 714 of FIG. 7 are sequentially outputted to the specific pixel location to obtain the visual effect of the target intensity (i.e., the intensity 65 in this embodiment).

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of dithering an image at a first bit depth for display on a display device at a second bit depth, the second bit depth being less than the first bit depth, the method comprising:

dividing a target curve of a predetermined function relating the first bit depth to the second bit depth into a plurality of intervals, the target curve spanning a predetermined range at least including original pixel values at the first bit depth being between two pixel values displayable at the second bit depth;

obtaining an interval number for the original pixel values at the first bit depth that cannot be directly represented at the second bit depth according to the target curve;

determining a plurality of appearance probabilities, one appearance probability being determined for each original pixel value according to a ratio between the interval number for that pixel value and a total number of intervals;

generating a dithering matrix having a plurality of entries, wherein a probability of appearance of each particular entry in the dithering matrix is according to the appearance probability for the original pixel value for which that entry corresponds; and dithering pixels of the image according to the dithering matrix to thereby generate an output image for display on the display device at the second bit depth.

2. The method of claim 1, further comprising generating the dithering matrix having integers being chosen randomly from zero to i, wherein i corresponds to how many original pixel values at the first bit depth are between each pixel value at the second bit depth.

3. The method of claim 2, wherein dithering the pixels of the image according to the dithering matrix to thereby generate the output image at the second bit depth further comprises:

adding each integer of the dithering matrix to a corresponding original pixel value; and truncating a plurality of resulting sums obtained in the adding step.

4. The method of claim 1, further comprising:

generating a plurality of different dithering matrixes for a plurality of different predetermined ranges of the target curve; and dithering the pixels of the image according to the dithering matrixes of the different ranges to thereby generate the output image at the second bit depth.

5. The method of claim 1, wherein the predetermined function corresponds to a non-linear characteristic curve.

6. The method of claim 5, wherein the predetermined function corresponds to a gamma characteristic curve of the display device.

7. The method of claim 1, wherein the dithering step is performed in a spatial domain.

8. The method of claim 1, wherein the dithering step is performed in a temporal domain.

9. The method of claim 1, further comprising intermittently adjusting the entries of the dithering matrix.

10. The method of claim 1, further comprising randomly rearranging positions of the entries within the dithering matrix.

11. An image dithering device for dithering an image at a first bit depth for display at a second bit depth, the second bit depth being less than the first bit depth, the image dithering device comprising:

a storage medium for storing a dithering matrix;

a dithering matrix generator for dividing a target curve of a predetermined function relating the first bit depth to the second bit depth into a plurality of intervals, the target curve spanning a predetermined range at least including original pixel values at the first bit depth being between two pixel values displayable at the second bit depth; obtaining an interval number for the original pixel values at the first bit depth that cannot be directly represented at the second bit depth according to the target curve; determining a plurality of appearance probabilities, one appearance probability being determined for each original pixel value according to a ratio between the interval number for that pixel value and a total number of intervals; and generating the dithering matrix having a plurality of entries, wherein a probability of appearance of each particular entry in the dithering matrix is according to the appearance probability for the original pixel value for which that entry corresponds; and a processing unit for dithering pixels of the image according to the dithering matrix to thereby generate an output image for display on a display device at the second bit depth.

12. The image dithering device of claim 11, wherein the dithering matrix generator is further for generating the dithering matrix having integers being chosen randomly from zero to i, wherein i corresponds to how many original pixel values at the first bit depth are between each pixel value at the second bit depth.

13. The image dithering device of claim 12, wherein the processing unit is further for adding each integer of the dithering matrix to a corresponding original pixel value; and truncating a plurality of resulting sums obtained in the adding step.

14. The image dithering device of claim 11, wherein the dithering matrix generator is further for generating a plurality of different dithering matrixes for a plurality of different predetermined ranges of the target curve; and the processing unit is further for dithering the pixels of the image according to the dithering matrixes of the different ranges to thereby generate the output image at the second bit depth.

15. The image dithering device of claim 11, wherein the predetermined function corresponds to a non-linear characteristic curve.

16. The image dithering device of claim 15, wherein the predetermined function corresponds to a gamma characteristic curve of the display device.

17. The image dithering device of claim 11, wherein the processing unit is further for dithering in a spatial domain.

18. The image dithering device of claim 11, wherein the processing unit is further for dithering in a temporal domain.

19. The image dithering device of claim 11, wherein the dithering matrix generator is further for intermittently adjusting the entries of the dithering matrix.

20. The image dithering device of claim 11, wherein the dithering matrix generator is further for randomly rearranging positions of the entries within the dithering matrix.

* * * * *